US006902061B1

(12) United States Patent
Elstone

(10) Patent No.: US 6,902,061 B1
(45) Date of Patent: Jun. 7, 2005

(54) COLLAPSIBLE LIQUID BOX

(76) Inventor: Paul Elstone, 420 Main St., Lumberton, NJ (US) 08055

( * ) Notice: Subject to any disclaimer, the term of this patent is extended or adjusted under 35 U.S.C. 154(b) by 0 days.

(21) Appl. No.: 09/675,744

(22) Filed: Sep. 29, 2000

(51) Int. Cl.[7] ..... B65D 19/00

(52) U.S. Cl. ..... 206/600; 206/596; 220/416; 220/417

(58) Field of Search ..... 206/600, 596, 206/598, 599; 220/4.16, 4.17, 6, 7, 495.06

(56) References Cited

U.S. PATENT DOCUMENTS

| | | | | | |
|---|---|---|---|---|---|
| 1,335,643 | A | * | 3/1920 | Beers et al. | 220/6 |
| 3,318,473 | A | * | 5/1967 | Jones et al. | 414/608 |
| 3,785,534 | A | * | 1/1974 | Smith | 222/460 |
| 4,165,024 | A | * | 8/1979 | Oswalt et al. | 222/105 |
| 4,247,021 | A | * | 1/1981 | Renier et al. | 222/143 |
| 4,397,406 | A | * | 8/1983 | Croley | 222/105 |
| 4,585,143 | A | * | 4/1986 | Fremow et al. | 206/386 |
| 4,606,461 | A | * | 8/1986 | Bolton, Sr. | 206/600 |
| 4,673,087 | A | * | 6/1987 | Webb | 206/600 |
| 4,817,824 | A | * | 4/1989 | LaFleur et al. | 222/105 |
| 4,880,141 | A | * | 11/1989 | Gossler et al. | 206/600 |
| 4,927,026 | A | * | 5/1990 | Gossler et al. | 206/600 |
| 5,029,734 | A | * | 7/1991 | Nichols | 222/105 |
| 5,111,937 | A | * | 5/1992 | Schutz | 206/386 |
| 5,253,763 | A | * | 10/1993 | Kirkley et al. | 206/600 |
| 5,269,414 | A | * | 12/1993 | D'Hollander | 206/600 |
| 5,318,219 | A | * | 6/1994 | Smith | 229/117.05 |
| 5,441,154 | A | * | 8/1995 | Youell, III | 206/599 |
| 5,507,392 | A | * | 4/1996 | Schutz | 206/600 |
| 5,564,599 | A | * | 10/1996 | Barber et al. | 222/105 |
| 5,934,474 | A | * | 8/1999 | Renninger et al. | 206/600 |
| 5,947,312 | A | * | 9/1999 | Elstone | 220/4.29 |

FOREIGN PATENT DOCUMENTS

| | | | | |
|---|---|---|---|---|
| GB | 2245883 | * | 1/1992 | 206/600 |
| WO | 93/17930 | * | 9/1993 | 220/4.16 |

* cited by examiner

*Primary Examiner*—Mickey Yu
*Assistant Examiner*—Troy Arnold
(74) *Attorney, Agent, or Firm*—Walter J. Tencza, Jr.

(57) ABSTRACT

A collapsible box for storing liquids, the box capable of being stacked while filled and then collapsed for convenient storage and return shipping when not filled. The box includes a base having a lip extending upwardly along the edges of the bottom panel. An upper sleeve is connected to the base by a base hinge, the upper panel being foldable by way of several other hinges to either an open or a closed position. A lid has a lip extending downwardly to selectively surround the top edges of the upper sleeve when the upper sleeve is in the open position, thereby forming an enclosure.

6 Claims, 18 Drawing Sheets

COLLAPSIBLE LIQUID BOX

This application is based on a provisional patent application titled Collapsible Liquid Box which was filed in the United States Patent & Trademark Office on Sep. 29, 1999 and which has a currently unknown provisional serial number. This application will be amended to reflect the serial number when same becomes known.

This invention is directed to the field of shipping, storage and delivery of liquid. In particular, this invention is directed to a collapsible box for storing liquids, the box capable of being stacked while filled and then collapsed for convenient storage and return shipping when not filled.

Various liquids, including water, are often shipped from their source to the location where they are needed. For example, during a military campaign, it is often necessary to deliver water to troops in the field for drinking, bathing and other needs.

While it is important to provide sturdy packaging for transporting and delivering liquids, the packaging itself creates its own difficulties. In particular, the containers often used are in many cases returned for reuse via the same types of vehicles that delivered them in the first place. Although the vehicles are capable of carrying the weight of a great number of empty containers, the large size of the containers requires a large amount of storage space, thereby restricting the number of containers that can be returned. This results in an inefficient use of the storage space on the return trip.

Various containers have been developed over the years in an effort to provide a collapsible container for different materials. U.S. Pat. No. 4,742,951 is directed to a container for bulk flowable materials. An octagonal-shaped cardboard sleeve is attached to the bottom end cap. The adjacent panels of the sleeve are connected alone elongate edges. A tubular inner member which is designed to withstand the pressure of the contained material is inserted inside the octagonal sleeve. A top end cap is attached to the top of the sleeve.

U.S. Pat. No. 4,927,026 is directed to a pallet box. Side walls of a container are hinged to the surface of a pallet. A tubular cardboard sleeve is positioned about the side walls and maintains the container shape. The container can be formed by criss-crossing panels attached to the pallet.

U.S. Pat. No. 5,178,275 is directed to an eight-sided columnar container for supporting bulk materials in sacks. An eight-sided collapsible sleeve is mounted to a pallet. Tabs are positioned along the bottom edge of each side of the container. Alternating tabs are bent inward or outward. The sacks of materials are disposed within the sleeve and a cap may be positioned on top of the sleeve.

U.S. Pat. No. 5,441,154 is directed to a integrated paperboard container and pallet system. The wall portion of the container has a polygonal-shaped interior cavity. At least one tab is formed at the bottom of one of the walls. The deck portion has a planar member with an upper side forming the floor surface and a lower side forming a support surface. Edges are mounted to the planar member and have a polygonal shape as the wall portion. Openings are positioned in the planar member to receive any tabs. The planar member is designed to be mounted on a pallet, if desired. The wall portion can be folded when it is not attached to the planar member.

U.S. Pat. No. 4,511,080 is directed to interlocking end closure flaps on a collapsible eight-sided receptacle. The receptacle is formed of a single blank of foldable sheet material. The flaps positioned along the bottom edges of the receptacle fold over to form the bottom of the container.

U.S. Pat. No. 5,269,414 is directed to an intermediate bulk container. The side walls of the container are made of a rigid material and are hinged to the base using one or two directional hinges. Sealing strips or separate bags are provided to prevent any leaking of material through the hinge. The bottom panel of the container may be ramped to direct the flow of material from the container. A cutting means can be provided at the exit of the container to allow for opening any internal bag holding the material.

U.S. Pat. No. 5,253,763 is directed to a collapsible container. The walls of the container are mounted by long, horizontal hinges attached to the walls. This container can be palletized.

U.S. Pat. No. 5,507,392 is directed to a pallet container with adapter frame. A hinged support insert is provided that folds upon itself using both internal and external hinges. The container may be provided with a plastic sloped bottom.

The military often uses a large, heavy container called a water buffalo for delivering water to troops. These water buffalos are not collapsible and take up a huge amount of space, whether they are filled with liquid or they are empty. When they are being transported back from the field, the transport vehicle is filled with empty receptacles, i.e., they are filled with heavy metal container and a lot of unused air space. If the water buffalos were collapsible, many more of them could be transported at the same time.

SUMMARY OF THE INVENTION it is an object of the present invention to provide a collapsible container which is sturdy enough to carry substantial loads of liquid and yet can be folded into a space-saving, self-contained configuration for later use.

It is another aspect of this invention to provide a collapsible container for liquids, which can be stacked for efficient storage and transportation.

It is another object of this invention to provide a container which allows access to the stored liquid via an aperture without endangering the structural integrity of the container.

It is another object of this invention to provide a liquid container which can be used repeatedly despite heavy weight and rough handling.

In accord with one aspect of the invention, a collapsible box is provided for storing and transporting liquid including a base having a bottom panel, the bottom panel having a front edge, a rear edge, a left edge, a right edge, and a base aperture. A base lip extends upwardly along the edges of the bottom panel and includes a front base lip attached to the front edge of the bottom panel, a rear base lip attached to the rear edge of the bottom panel, a left base lip attached to the left edge of the bottom panel, and a right base lip attached to the right edge of the bottom panel. An upper sleeve includes a rear panel having a bottom edge, a top edge, a left edge and a right edge, said rear panel being connected by a base hinge to the rear base lip along the bottom edge of the rear panel. The upper sleeve also includes a rear left side panel connected by a left rear hinge to the rear panel along the left edge of the rear panel. The upper sleeve further includes a front left side panel connected by a left central hinge to the rear left side panel along an edge of the rear left side panel distal to the rear panel. The upper sleeve also includes a rear right side panel connected by a right rear hinge to the rear panel along the right edge of the rear panel. The upper sleeve has a front right side panel connected by a right central hinge to the rear right side panel along an edge of the rear right side panel distal to the rear panel. The sleeve further includes a front panel having a left edge, a right edge, a bottom edge and a top edge, said left edge being connected by a front left hinge to the front left side panel along an edge distal to the rear left side panel; said right edge being connected by a front right hinge to the front right side panel along an edge distal to the rear right side panel. The combined length of the rear left side panel hinged to the front left side panel is less than the length of the rear panel of the sleeve; and the combined length of the rear right side panel hinged to the front right side panel is less than the length of the rear panel of the sleeve. The upper sleeve is foldable to an open position in which the bottom edge of the front panel extends along the front edge of the bottom panel, the rear left panel hinged to the front left panel extends along the left edge of the bottom panel, and the rear right side panel hinged to the front right side panel extends along the right edge of the bottom panel, such that the base lip surrounds the bottom edges of the upper sleeve. The upper sleeve is also foldable to a closed position in which the right and left side panels are folded about their respective right side and left side central hinges onto the rear panel; and the bottom panel, the front panel, the rear panel, and the side panels extend in substantially parallel planes. Also included is a lid having a top panel, the top panel having a front edge, a rear edge, a left edge, a right edge, and a lid aperture. A lid lip extends downwardly along the edges of the top panel, including a front lid lip attached to the front edge of the top panel, a rear lid lip attached to the rear edge of the top panel, a left lid lip attached to the left edge of the top panel, and a right lid lip attached to the right edge of the top panel. The lid lip is sized to selectively surround the top edges of the upper sleeve when the upper sleeve is in the open position, thereby forming an enclosure. Further included is a liquid storage bag sized to fit inside the enclosure, said bag having a closeable liquid inlet in the top capable of fitting through the lid aperture and also having a closeable liquid outlet in the bottom capable of fitting through the base aperture, said bag having a curtain extending outwardly from the top of said bag such that the curtain is squeezed between the lid lip and the upper sleeve when the sleeve is in an open position and the lid is placed on top of the sleeve. Further included is a plurality of base connectors to securely attach the base to the sleeve when the sleeve is in an open position, and a plurality of lid connectors to securely attach the lid to the sleeve when the sleeve is in an open position. The box further comprises a plurality of latches to connect the base to the lid when the sleeve is in the closed position.

DESCRIPTION OF PREFERRED EMBODIMENTS

Figure 1:
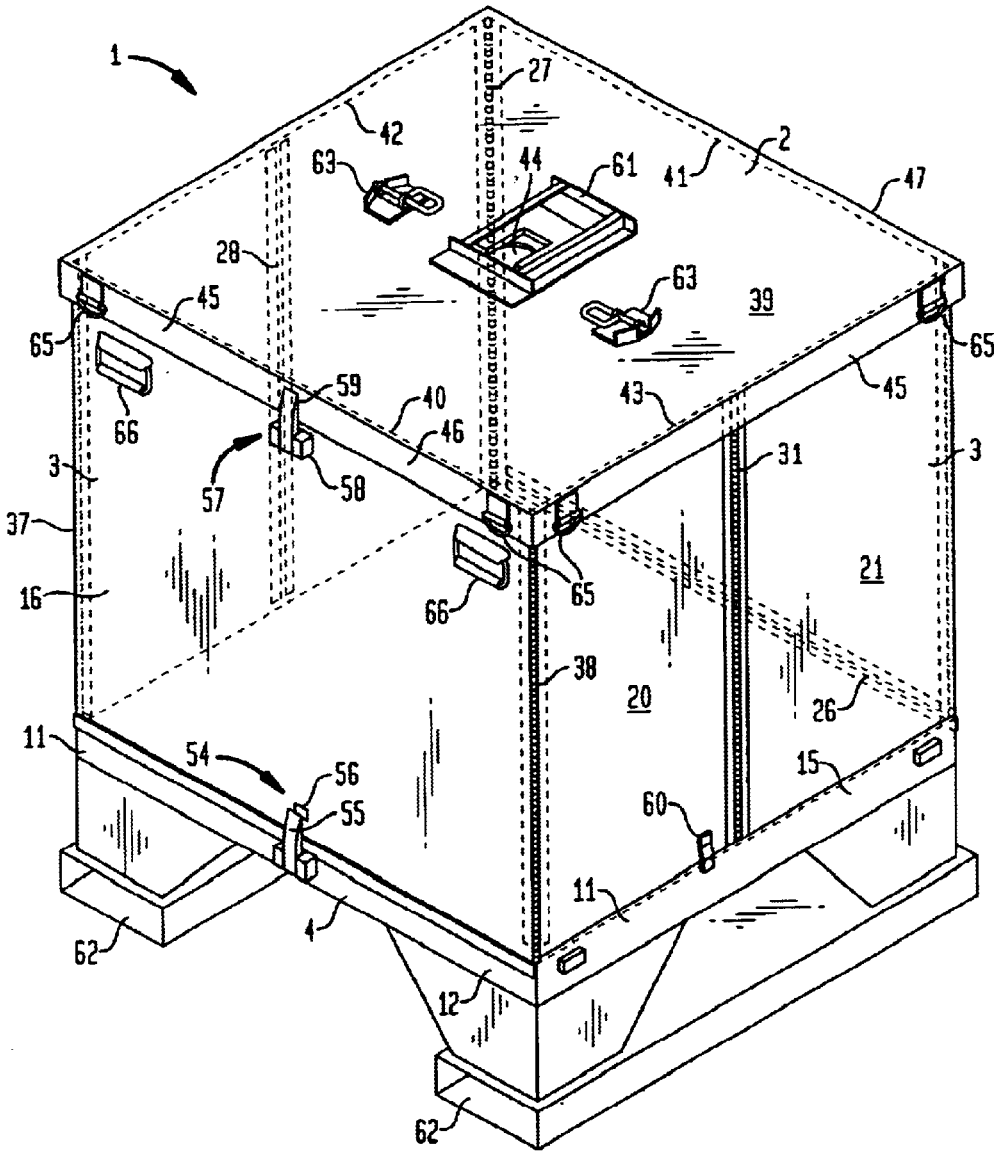
FIG. 1 is a perspective view of a collapsible box in accord with the instant invention in an assembled condition and showing the hinges on the inside of the box.

Referring to the drawings, there is shown a collapsible box 1 for storing and transporting liquid including a lid 2, an upper sleeve 3 and a base 4. The base 4 has a bottom panel 5, said bottom panel 5 having a front edge 6, a rear edge 7, a left edge 8, a right edge 9, and a base aperture 10. (The bottom panel 5 may be flat, i.e., horizontal, or it may preferably take a conical shape as shown in the drawings. Such conical shape would tend to channel any spilled liquid out of the box.) A base lip 11 extends upwardly along the edges 6, 7, 8 and 9 of the bottom panel 5. The base lip 11 has a front base lip 12 attached to the front edge 6 of the bottom panel 5, a rear base lip 13 attached to the rear edge 7 of the bottom panel 5, a left base lip 14 attached to the left edge 8 of the bottom panel 5, and a right base lip 15 attached to the right edge 9 of the bottom panel 5. The upper sleeve 3 is comprised of a front panel 16 and a rear panel 17 which are attached together on the left side by a front left side panel 18 and a rear left side panel 19, and on the right side by a front right side panel 20 and a rear right side panel 21. As discussed more fully below, central hinges are provided in the side panels allowing them to fold in half over the front and rear panels. The total length of each side panel does not exceed the total length of either the front panel or the rear panel.

Figure 2:
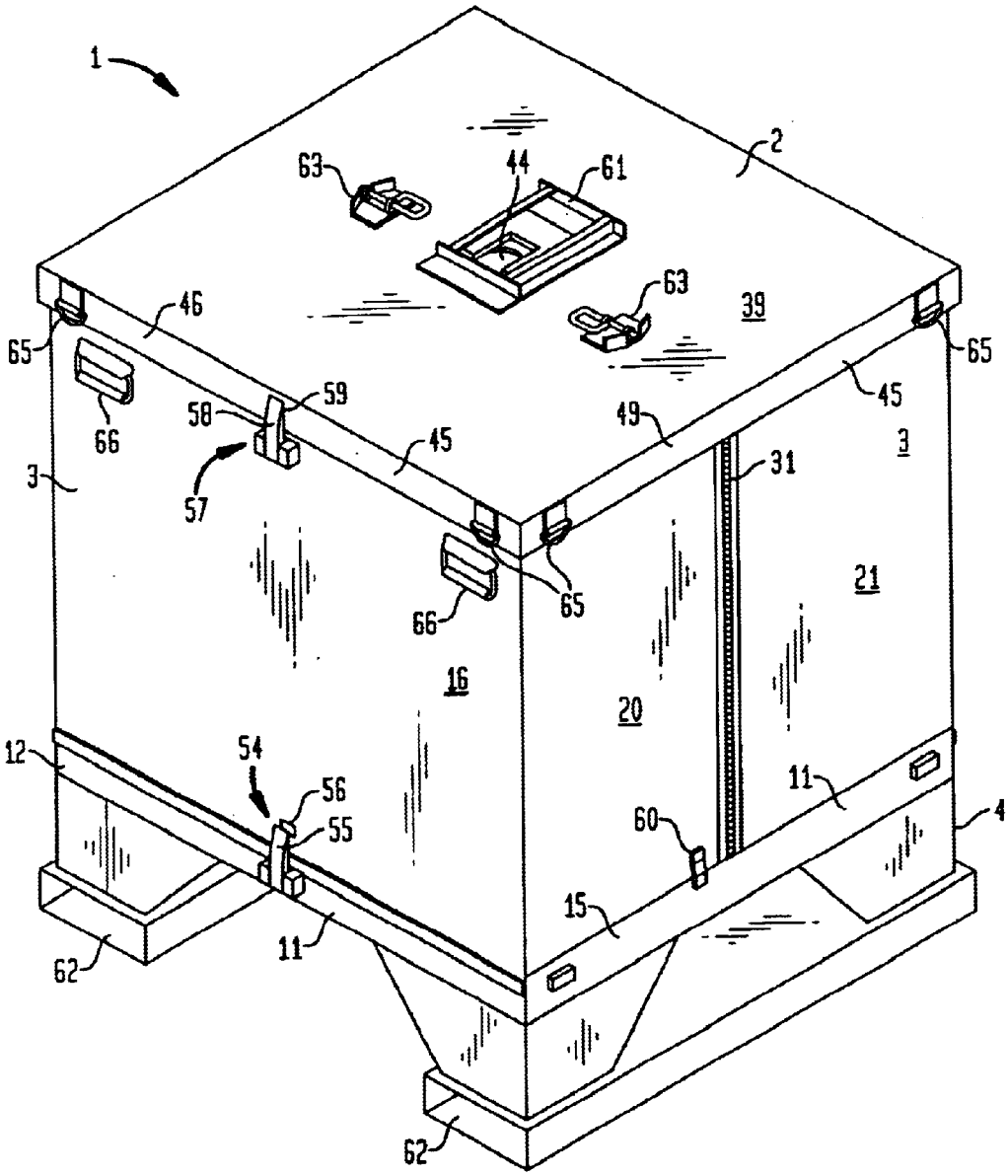
FIG. 2 is perspective view of a collapsible box in accord with the instant invention in an assembled condition.

In FIGS. 1 and 2, the box 1 is in an assembled position, with the upper sleeve 3 on the base 4 and the lid 2 on the upper sleeve 3. An interior cavity for the storage of liquid is thus formed between the lid the base and the sleeve. When the box is not in use, the upper sleeve 3 can be collapsed into the base 4 and the lid 2 is attached to the base, enclosing the folded upper sleeve 3.

Preferably the base 4, the upper sleeve 3 and the lid 2 are made of a rigid material, such as steel or aluminum. Of course, other materials, such as plastic and the like, can be employed in the practice of this invention. The material should be selected such that the assembled box can withstand the weight of another box and its contained load of liquid stacked on the lid. Aluminum is the preferred material.

Referring now to the upper sleeve 4, the rear panel 17 has a bottom edge 22, a top edge 23, a left edge 24 and a right edge 25, said rear panel 17 being connected by a base hinge 26 to the rear base lip 13 along the bottom edge 22 of the rear panel 17. The base hinge 26 is an interior hinge allowing the rear panel 17 to fold inward onto the base 4. However, as the rear panel 17 is rotated upward, it engages the rear base lip 13 thereby preventing rotation much beyond the vertical position. The rear left side panel 19 is connected by a rear left hinge 27 to the rear panel 17 along the left edge 24 of the rear panel 17. The front left side panel 18 is connected by a left central hinge 28 to the rear left side panel 19 along an edge 29 of the rear left side panel distal to the rear panel 17. The rear right side panel 21 is connected by a right rear hinge 30 to the rear panel 17 along the right edge 25 of the rear panel 17. The front right side panel 20 is connected by a right central hinge 31 to the rear right side panel 21 along an edge 32 of the rear right side panel 21 distal to the rear panel 17. As the left rear side panel 19 is rotated outward, the left rear side panel 19 and the rear panel 17 engage or abut thereby restricting further rotation. As the right rear side panel 21 is rotated outward, the right rear side panel 21 and the rear panel 17 engage or abut thereby restricting further rotation. The front panel 16 of the upper sleeve 3 has a left edge 33, a right edge 34, a bottom edge 35 and a top edge 36, said left edge 33 being connected by a front left hinge 37 to the front left side panel 18 along an edge distal to the rear left side panel 19; said right edge 34 being connected by a front right hinge 38 to the front right side panel 20 along an edge distal to the rear right side panel 21. The combined length of the rear left side panel 19 hinged to the front left side panel 18 is less than the length of the rear panel 17. The combined length of the rear right side panel 21 hinged to the front right side panel 20 is less than the length of the rear panel 17.

The upper sleeve 2 is foldable to an open position in which the bottom edge of the front panel 16 extends along the front edge of the bottom panel 5 of base 4, the rear left panel 19 hinged to the front left panel 18 extends along the left edge of the bottom panel 5, and the rear right side panel 21 hinged to the front right side panel 20 extends along the right edge of the bottom panel 5, such that the base lip 11 surrounds the bottom edges of the upper sleeve 3.

The upper sleeve 2 is foldable to a closed position in which the right and left side panels (18, 19, 20 and 21) are folded about their respective right side and left side central hinges (31 and 28) onto the rear panel 17, and the bottom panel 5, the front panel 16, the rear panel 17 and the side panels (18, 19, 20 and 21) extend in substantially parallel planes.

The lid 2 has a top panel 39, with a front edge 40, a rear edge 41, a left edge 42, a right edge 43 and a lid aperture 44. A lid lip extends downwardly along the edges (40, 41, 42 and 43) of the top panel 39, including a front lid lip 46 attached to the front edge 40 of the top panel 39, a rear lid lip 47 attached to the rear edge 43 of the top panel 39, a left lid lip 48 attached to the left edge 41 of the top panel 39, and a right lid lip 49 attached to the right edge 43 of the top panel 39. The lid lip 45 is sized to selectively surround the top edges of the upper sleeve 3 when the upper sleeve is in the open position, thereby forming an enclosure.

A liquid storage bag 50 is sized to fit inside the enclosure of the box 1, said bag 50 having a closeable liquid inlet 51 capable of fitting through the lid aperture 44, said bag 50 also having a closeable liquid outlet 52 capable of fitting through the base aperture 10. The bag 50 has a curtain 53 extending outwardly from the top of said bag such that the bag is squeezed between the lid lip 45 and the upper sleeve 3 when the sleeve is in an open position and the lid 2 is placed on top of the sleeve. The bag can be made of any material capable of containing liquid. Preferably, the bag is made of polyethylene and is preferably at least 10 mils thick.

Figure 10:
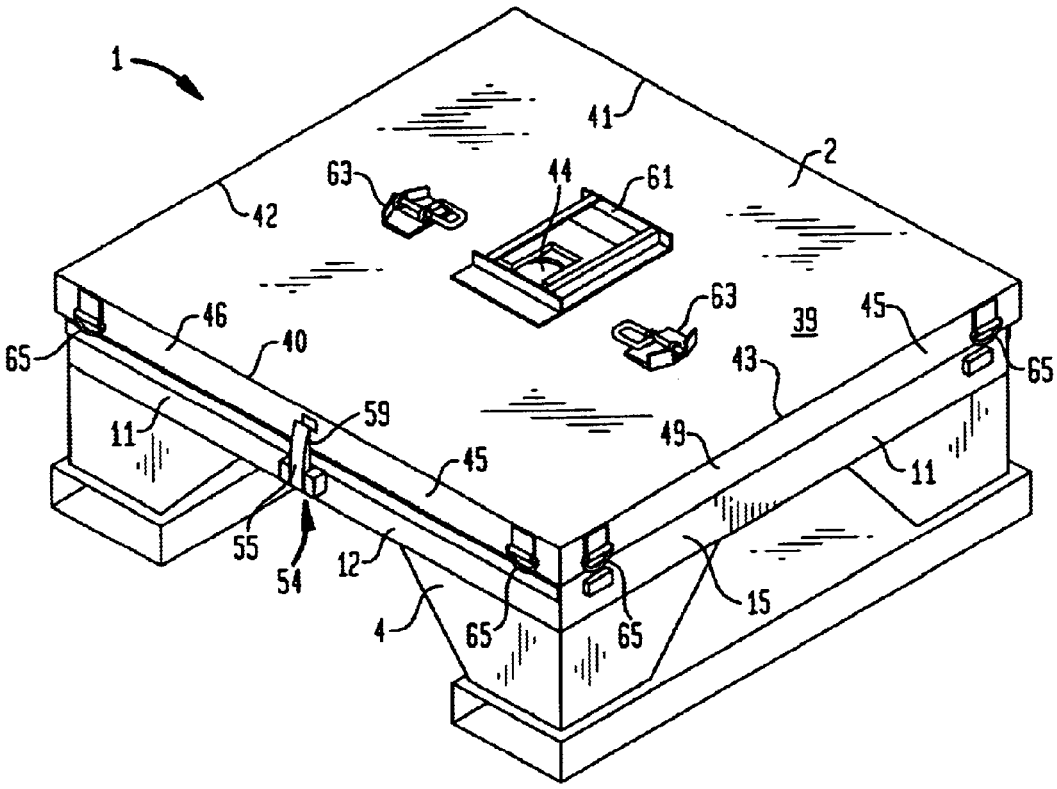
FIG. 10 is a perspective view showing the box in a fully collapsed position.
Figure 11:
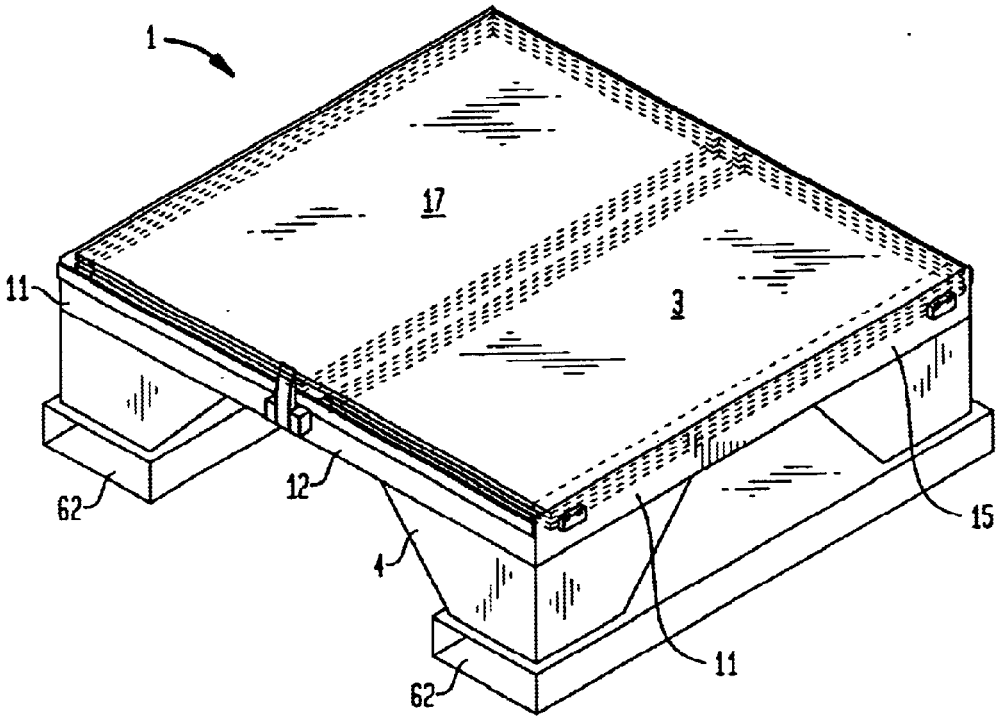
FIG. 11 is a perspective view showing the box in a fully collapsed position and showing the upper sleeve as it positioned inside the box.
Figure 12:
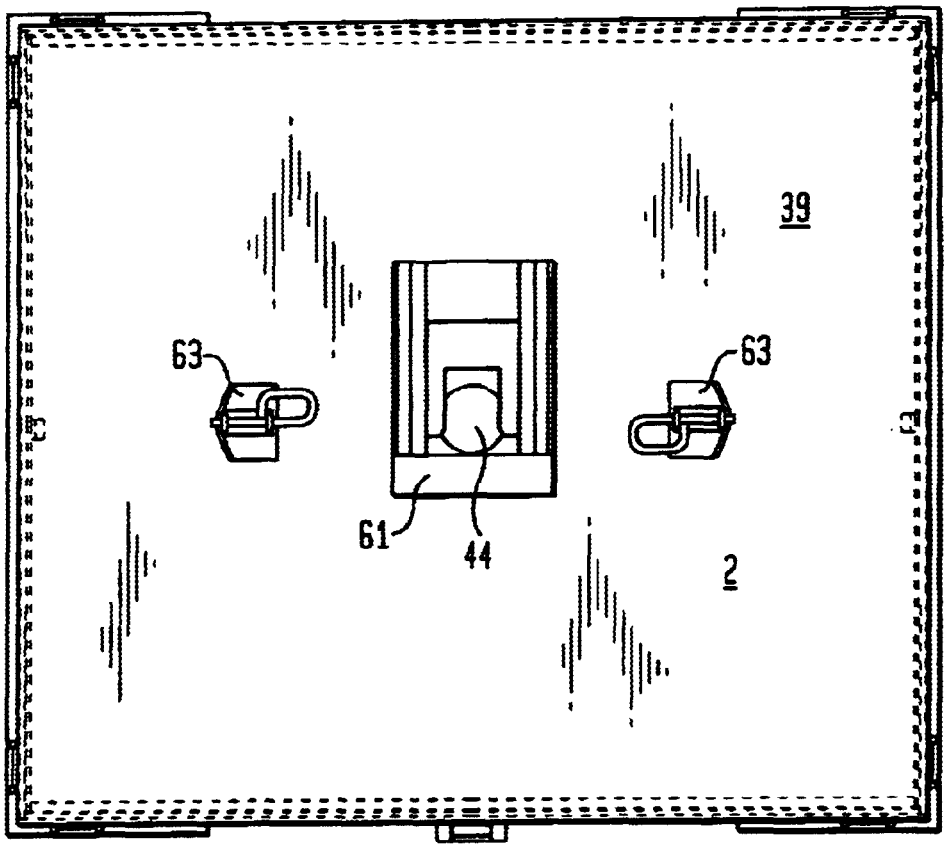
FIG. 12 is a top plan view showing the box in a fully collapsed position and showing the upper sleeve as it is positioned inside the box.
Figure 13:
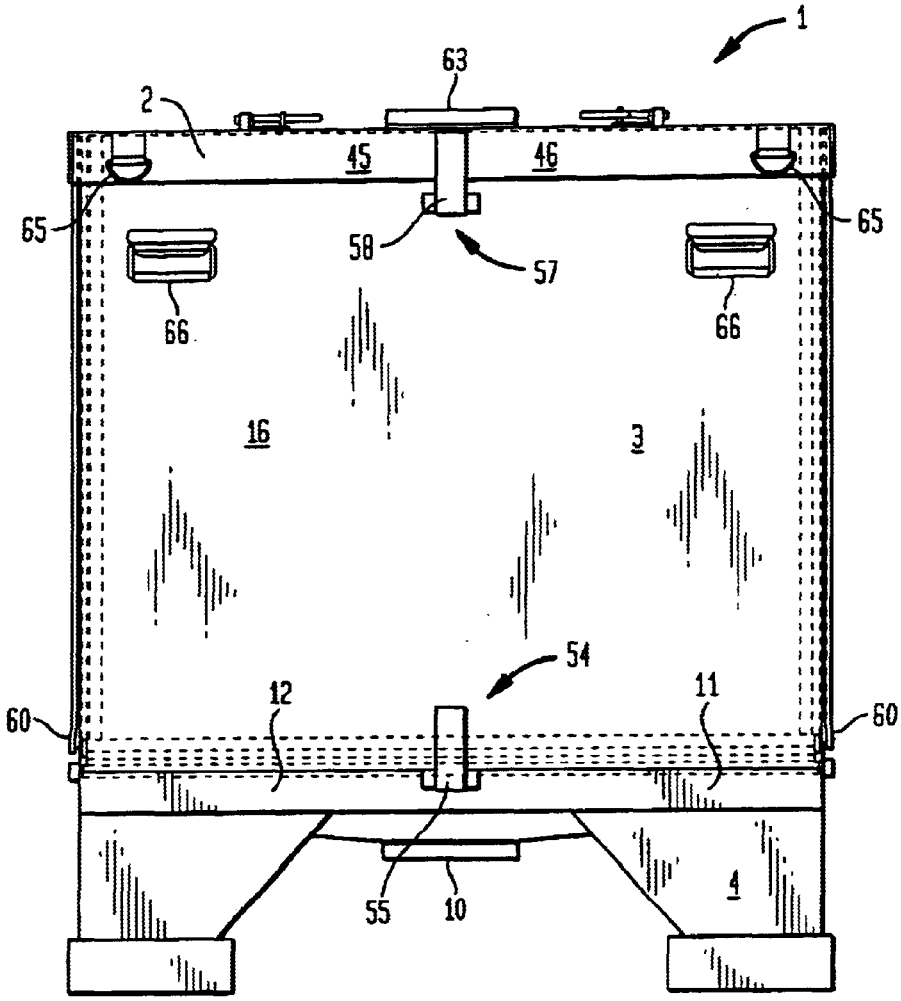
FIG. 13 is a front elevation view of the box in an opened position.
Figure 14:
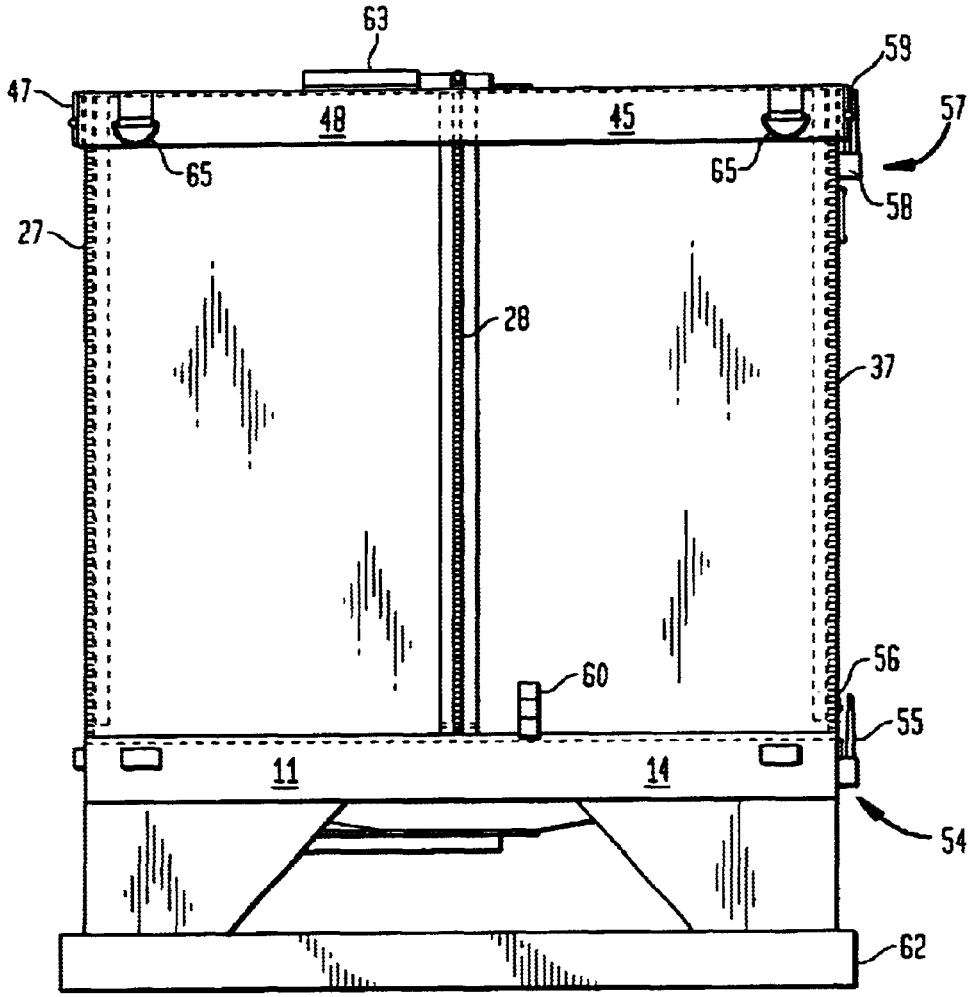
FIG. 14 is a side elevation view of the left side of the box in an open position.
Figure 15:
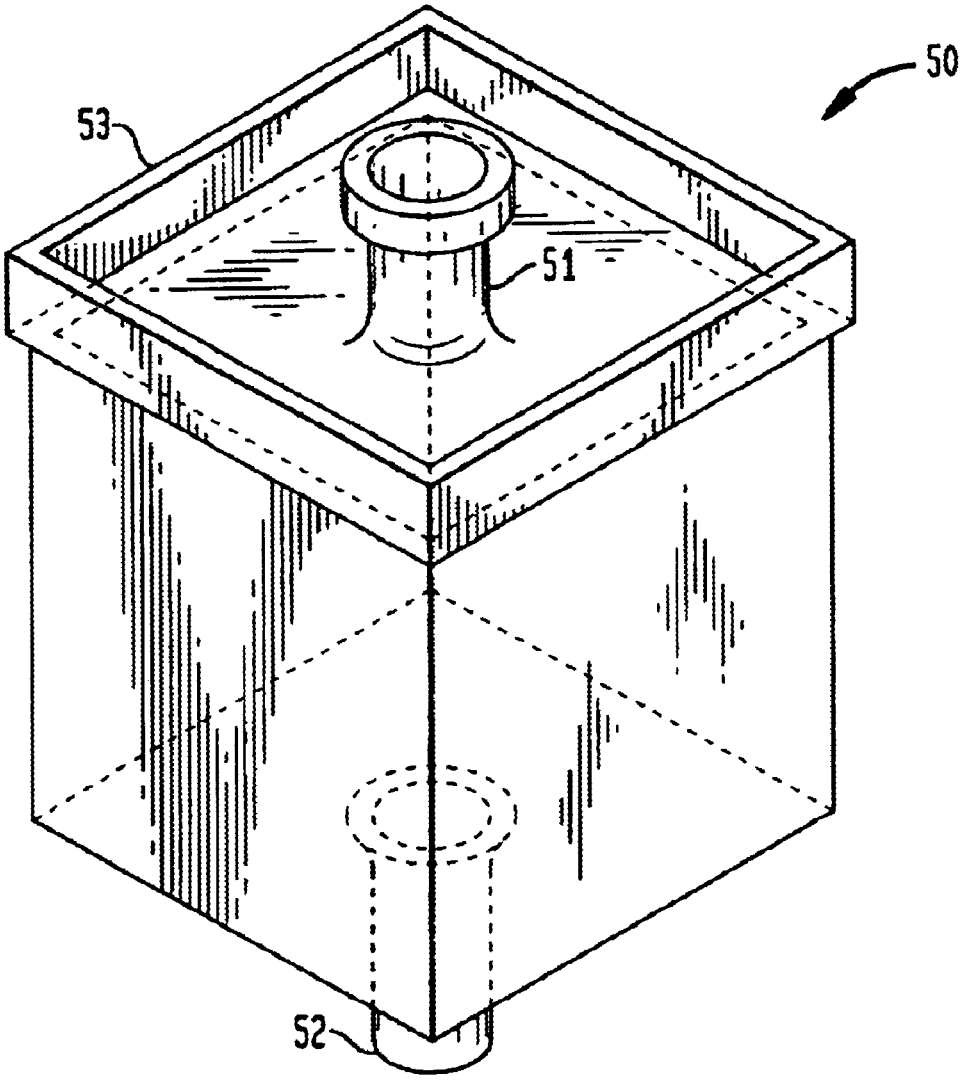
FIG. 15 is a perspective view of a liquid storage bag to be used on the inside of the box in an open position.

Preferably the base 4 includes a plurality of base connectors 54 to securely attach the base 4 to the sleeve 3 when the sleeve is in an open position. While many different types of connectors might be used, one type is a spring-loaded connector having a latch 55 attached on the outside of the base lip 11 and a latch receptor 56 attached to the sleeve 3. Additionally, it is preferable that the lid 2 includes a plurality of lid connectors 57 to attach the lid 2 to the sleeve 3 when the sleeve is in an open position. The lid connectors can be of any design such as may be used for the base connectors 54, for example as shown by the latch 58 on the sleeve 3 and the latch receptor 59 on the lid lip 45. The base connector(s) 54 and the lid connector(s) 57 are preferably aligned in a manner such that when the box is in a fully closed position, one part of a base connector will selectively mate with and attach to one part of a lid connector, thereby securing the closed box in the closed position such as shown in FIG. 10. Alternatively, separate connectors may be used to secure the box in the closed position.

Preferably the upper sleeve 3 has one or more tabs 60 extending vertically downward on the outside of the sleeve. Said tabs are placed so as to overlap the base lip 11 when the upper sleeve 3 is in an open position. This provides support for the upper sleeve 3 and helps to keep the box from collapsing unintentionally.

The liquid storage bag 50 can be equipped with many different and varied kinds of fittings suitable for loading and unloading the bag with liquid, and for keeping the liquid safely stored within the bag. Preferably the lid 2 contains a support to keep the liquid inlet 51 of the liquid storage bag 50 extending through the lid aperture to the outside of the box thereby providing quick and easy access for filling the bag. This might take the form of a simple slide gate 61 to selectively grab and hold the bag and/or fittings attached to the bag in such a position.

Fork-lift channels 62 are preferably included in the base 4 of the box to facilitate movement of a box.

Figure 16:
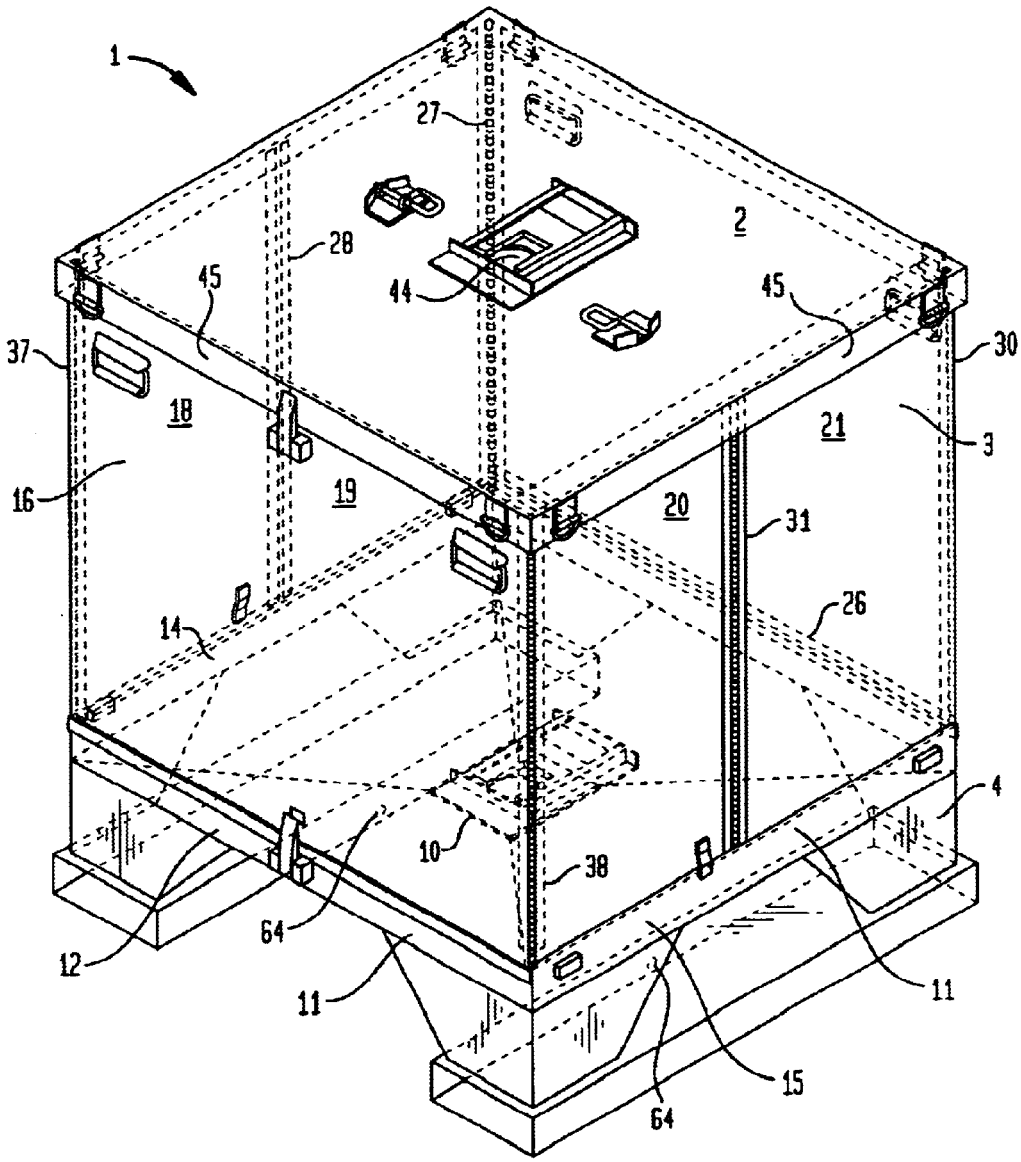
FIG. 16 is another perspective view of a box of the instant invention.
Figure 17A:
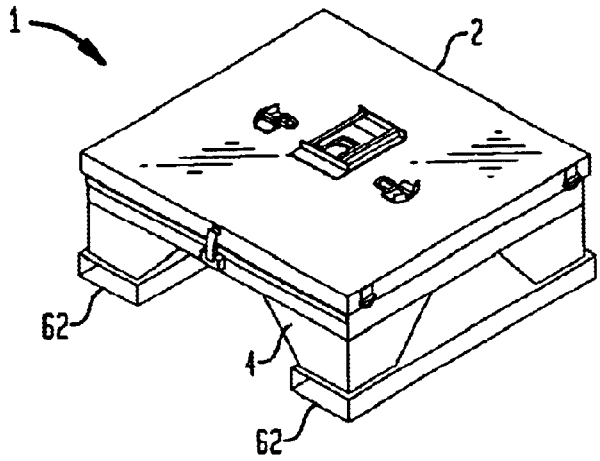
FIG. 17 is a series of drawings (A through D) showing the box in various stages beginning when it is fully collapsed (A) and ending with the box in a fully opened position and ready for use (D).
Figure 17B:
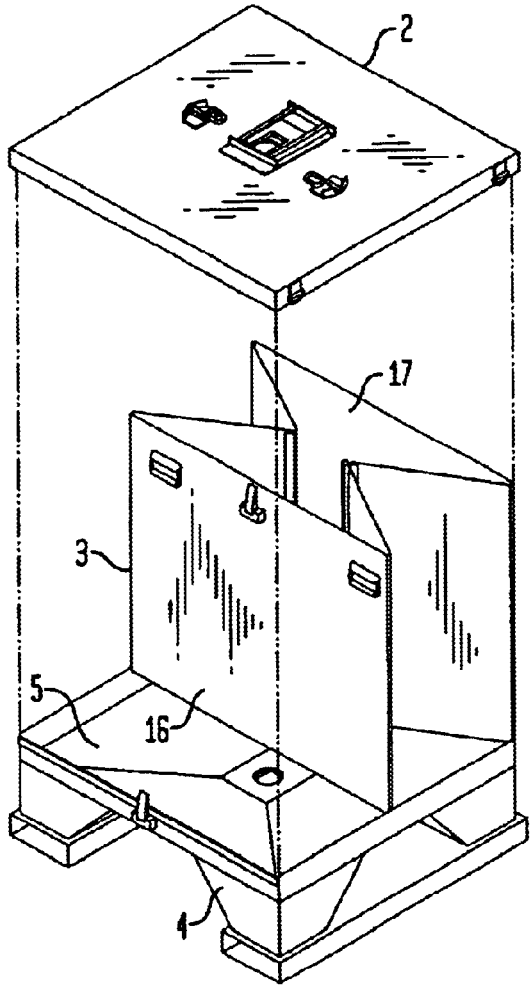
Figure 17C:
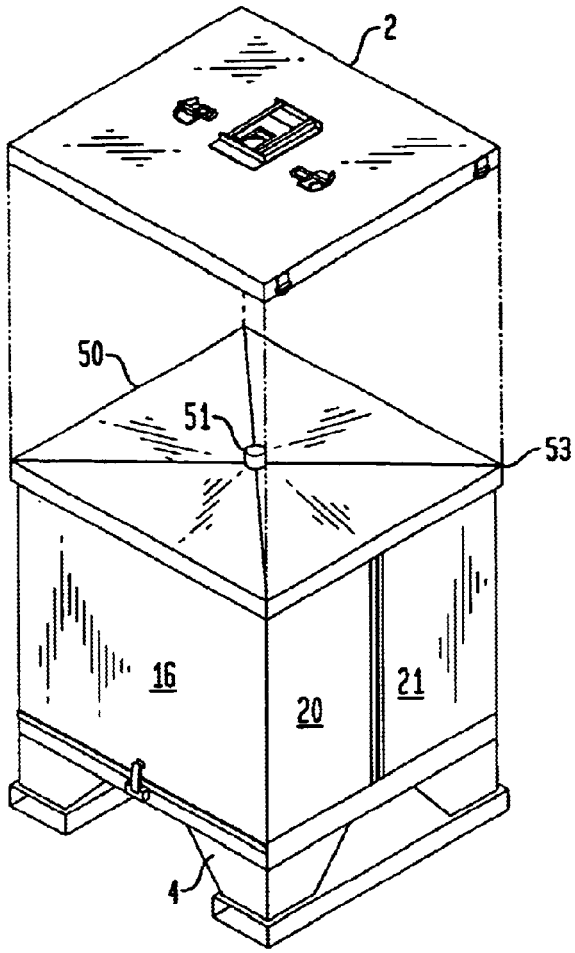
Figure 17D:
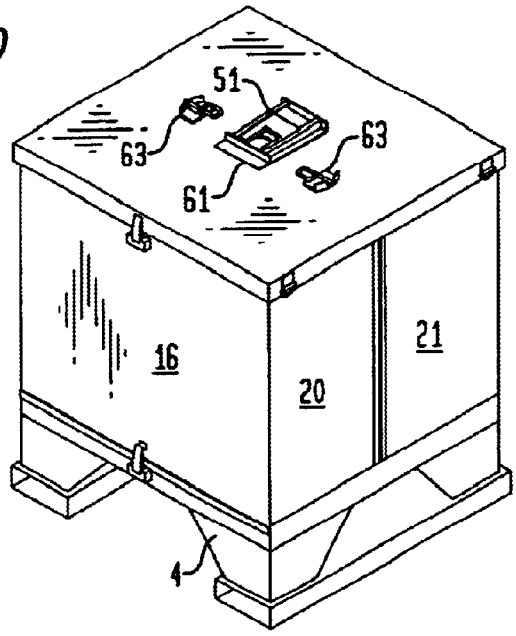

While the containers may be stacked one upon the other, it is preferable to include a stacking latch to safely secure one box to another box. There are many different ways of accomplishing this. One way is having one or more slide bolts 63 attached to the top of the lid 2. Said slide blots 63 selectively mate with corresponding holes 64 in the base 4 of the box 1 as shown in FIG. 16.

When not in use, the box 1 is normally maintained in a closed position as shown in FIG. 10. To reach the closed position, the upper sleeve 3 is folded into itself and is placed in a substantially horizontal position in the base 4. The lid 2 is secured directly to the base 4 by connecting the latch 55 on the base lip 11 to the latch receptor 59 on the lid 2. Tie-down loops 65 may be provided for securing the box during shipping. Further, handles 66 may be provided on the box 1 to facilitate carrying same.

Figure 3:
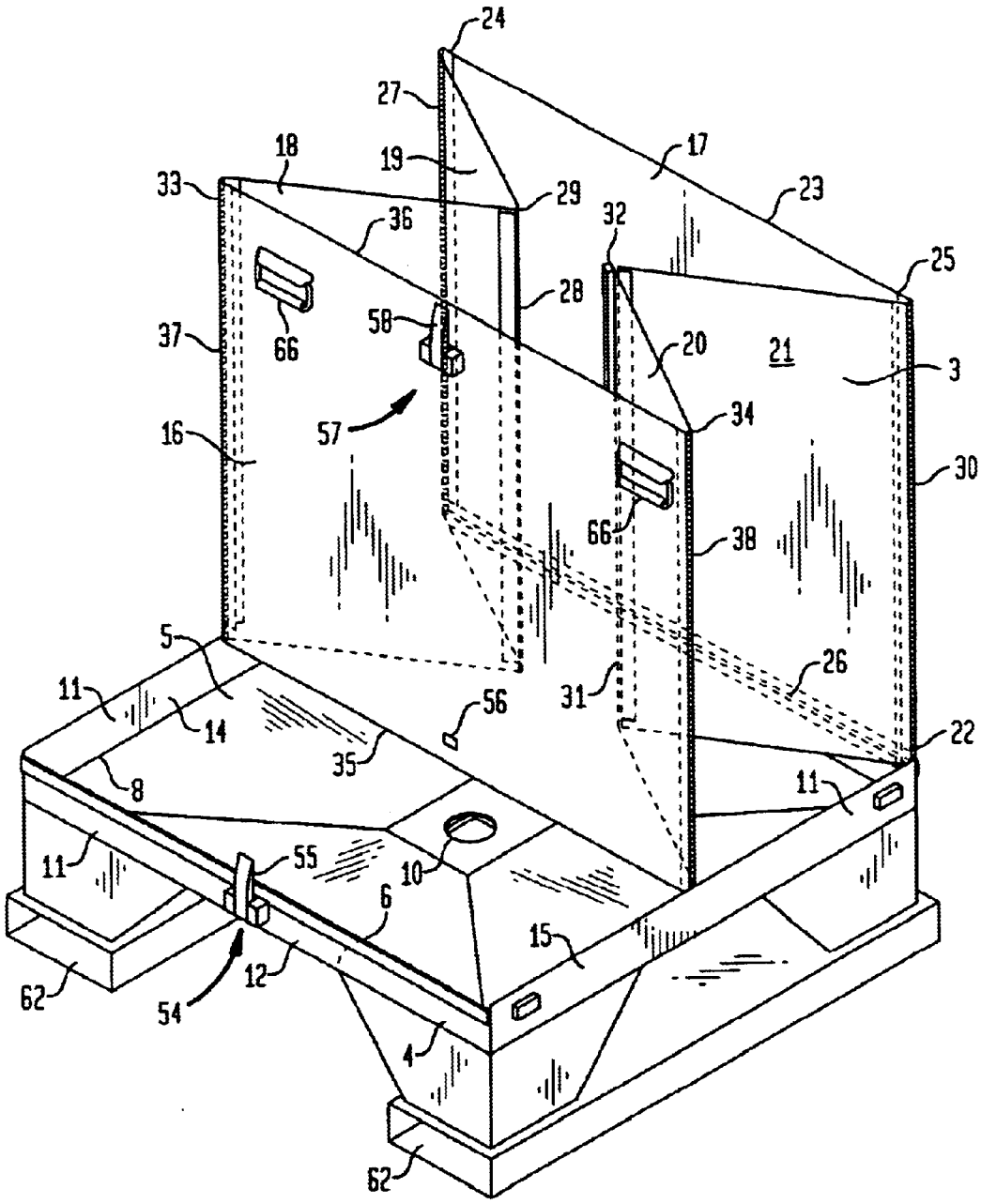
FIG. 3 is a perspective view of a partially collapsed upper sleeve sitting in the base of the box, and showing the hinges on the inside of the box.
Figure 4:
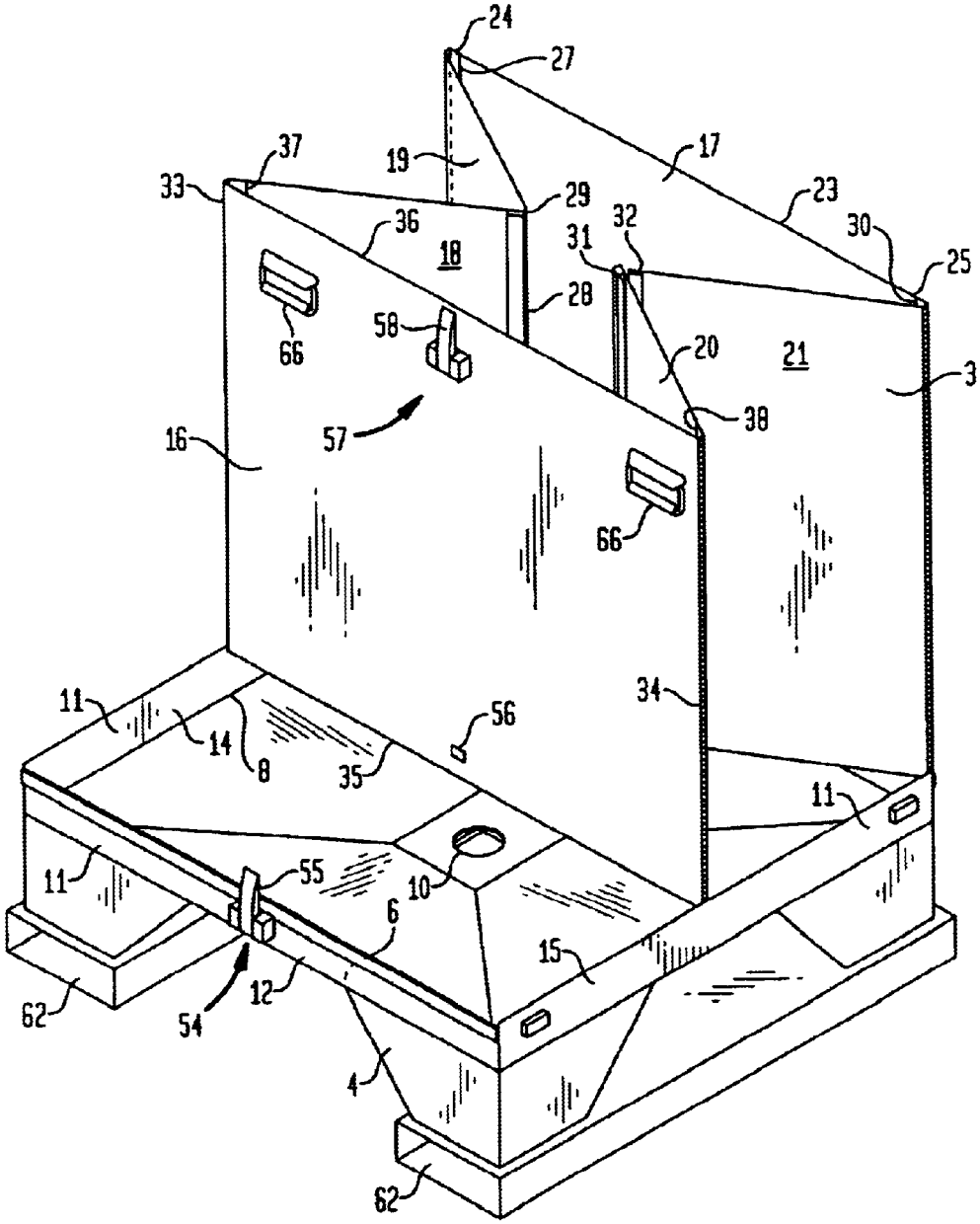
FIG. 4 is a perspective view of a partially collapsed upper sleeve sitting in the base of the box.
Figure 5:
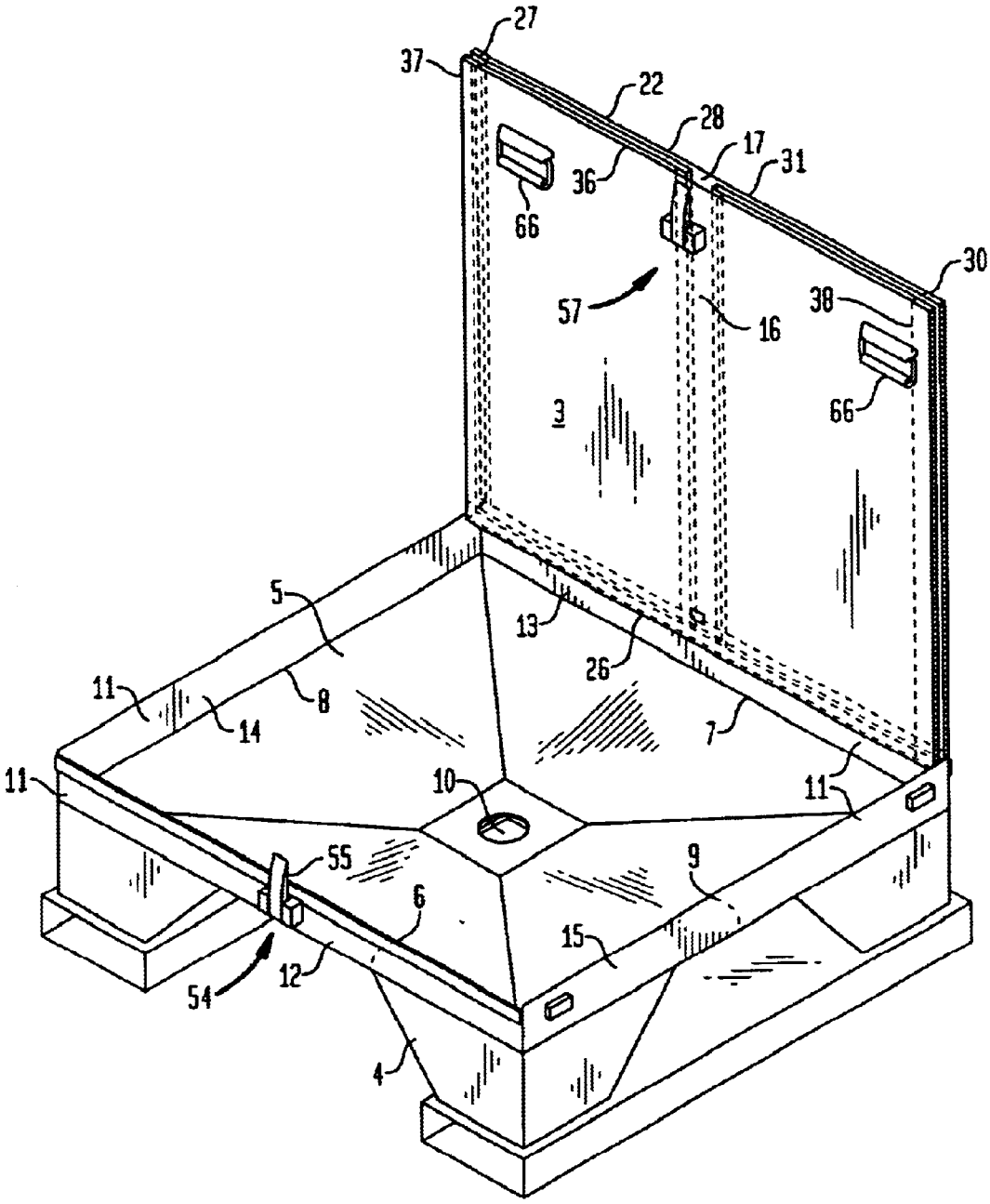
FIG. 5 is a perspective view showing the upper sleeve in a fully closed but vertical position, and showing the hinges on the inside of the sleeve, with the upper sleeve sitting in the base of the box.
Figure 6:
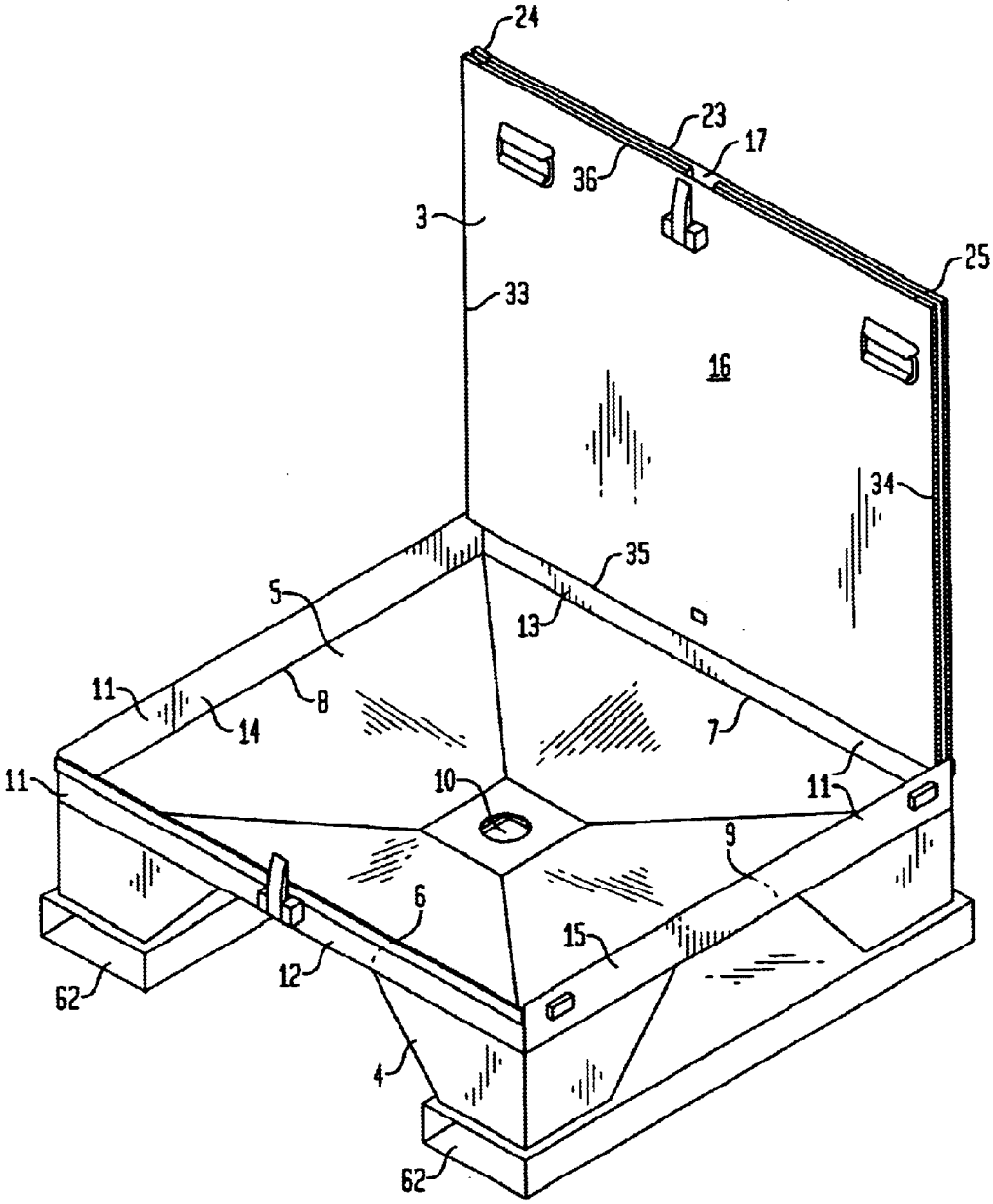
FIG. 6 is a perspective view showing the upper sleeve in a fully closed but vertical position and sitting in the base of the box.
Figure 7:
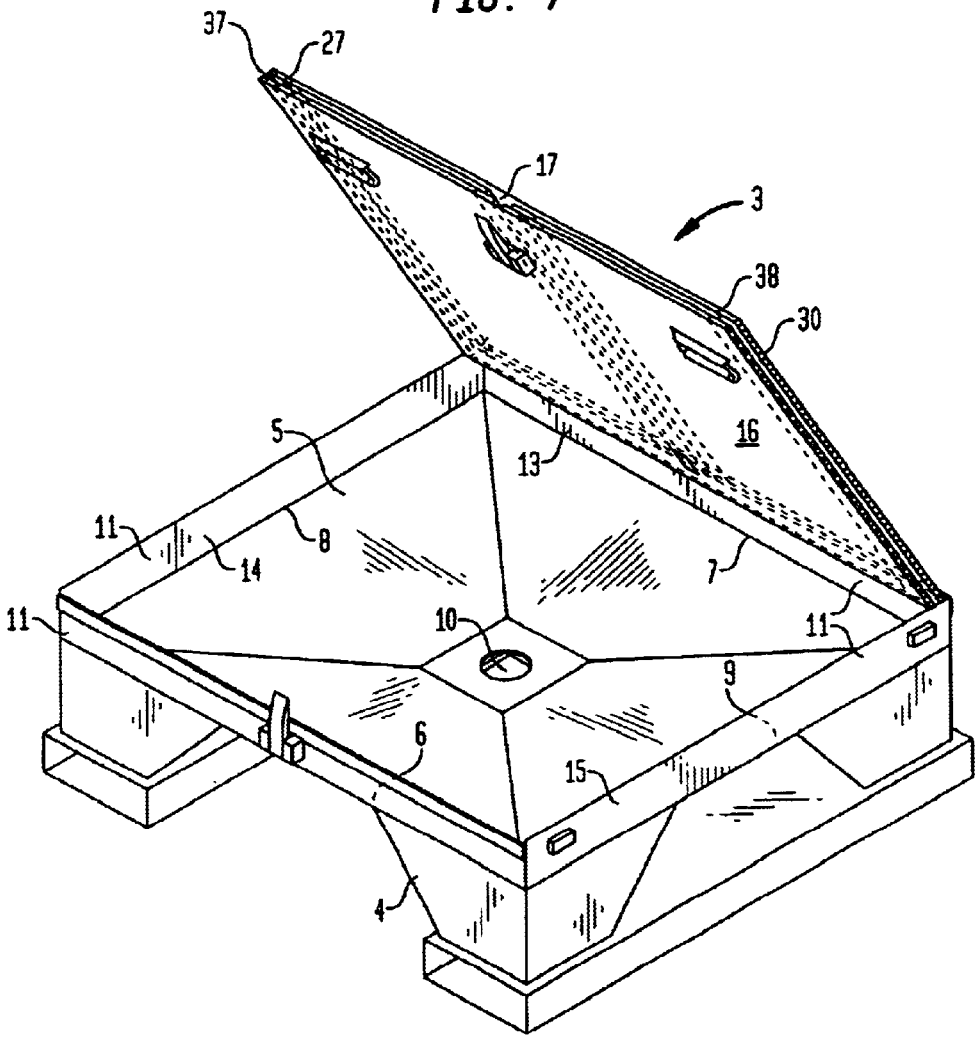
FIG. 7 is a perspective view showing the upper sleeve in a fully closed and partially raised position and showing the hinges.
Figure 8:
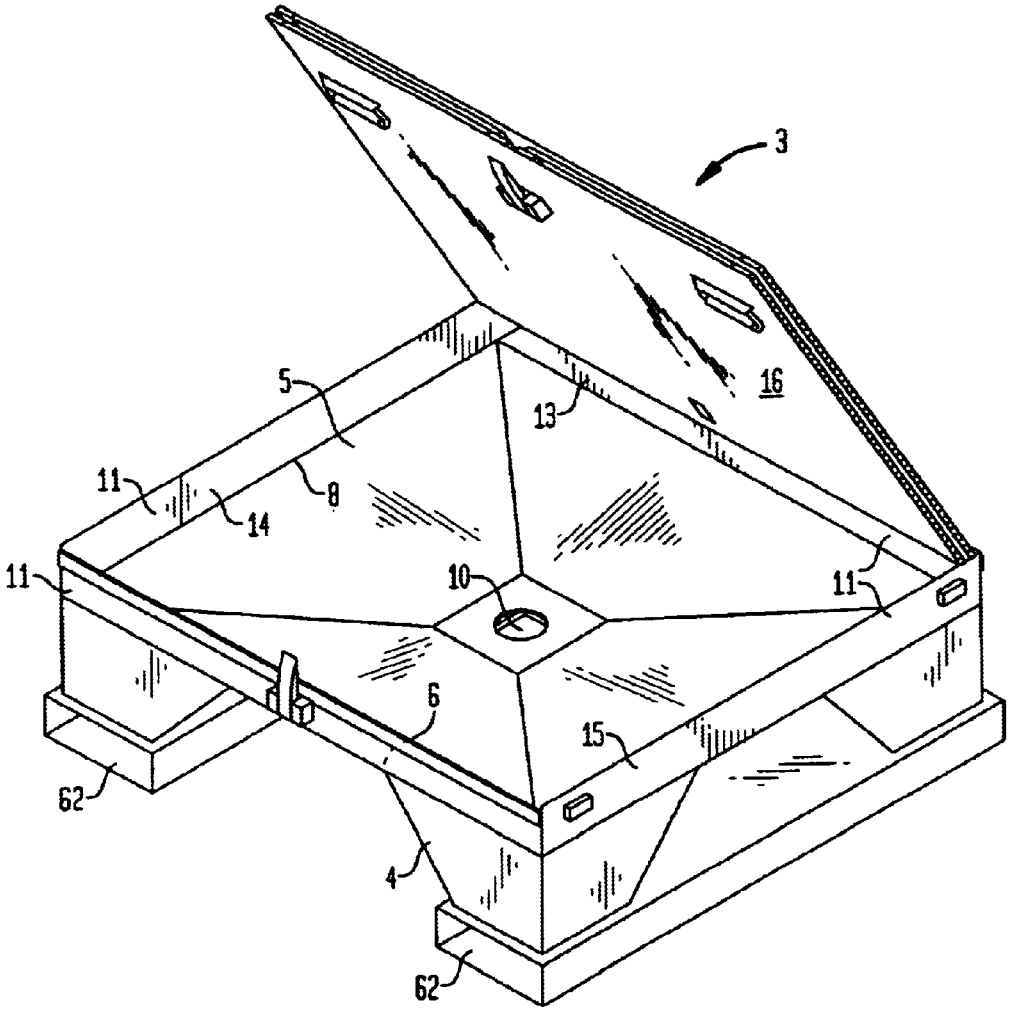
FIG. 8 is a perspective view showing the upper sleeve in a fully closed and partially raised position.
Figure 9:
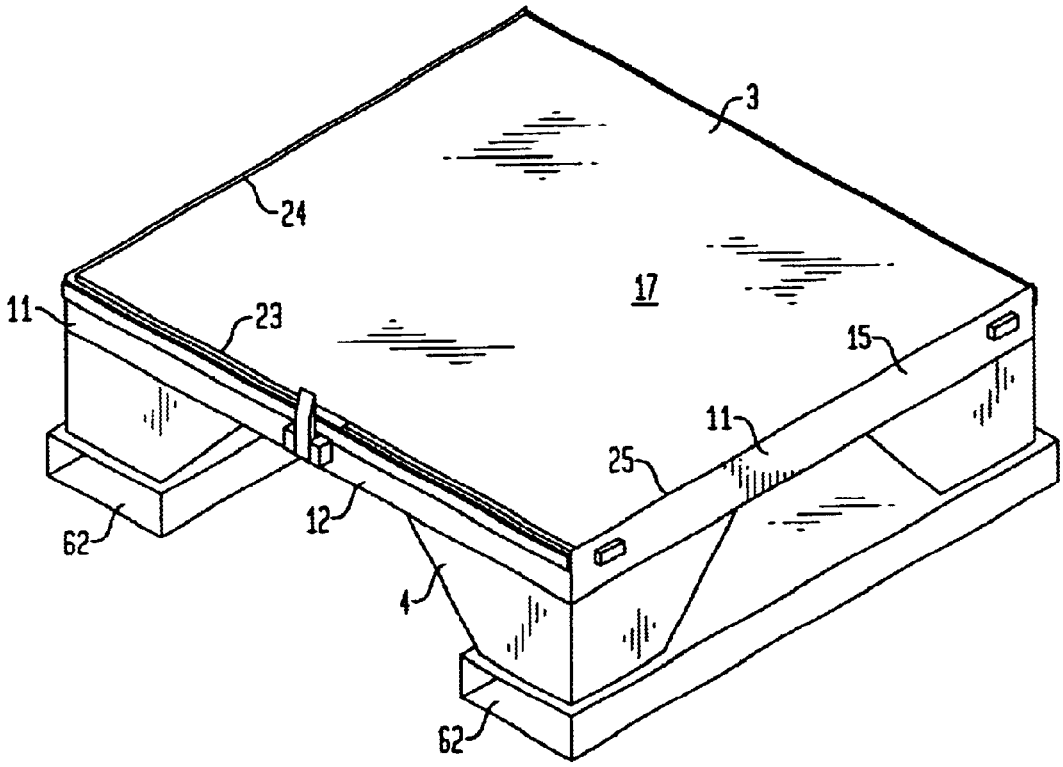
FIG. 9 is a perspective view showing the upper sleeve in a fully closed and substantially horizontal position.

To use the box 1, the latch 55 on the base lip 11 is released from the latch receptor 59 on the lid 2. The lid 2 is removed. The upper sleeve 3 inside the box 1 is rotated upward about the base hinge 26. the side panels 18, 19, 20 and 21 are then free to "accordion" outward (see FIG. 3) displacing the front panel 16 away from the rear panel 17 and creating the central cavity of the box 1. Once the rear panel 17 is rotated to a position substantially vertical, the rear panel 17 starts to abut the rear base lip 14 preventing further rotation of the upper sleeve 3. The front panel 16 is then displace forward until it abuts the front base lip 12. Once the front panel is in position, the base connector(s) 54 are used to secure the upper sleeve 3 to the base 4 as shown in FIG. 2. The side panels 18 & 19 and 20 & 21 extend respectively along the left base lip 14 and the right base lip 15. These side panels may be somewhat loose. Hence, tabs 60 are used to keep the sleeve 3 from collapsing inadvertently.

Once the upper sleeve 3 is in position, a liquid storage bag 50 is inserted into the cavity created by the upper sleeve 3. The liquid storage bag 50 sized to fit inside the enclosure, said bag having a closeable liquid inlet 51 in the top that fits through the lid aperture 44, said bag having a closeable liquid 52 outlet in the bottom that fits through the base aperture 10. The curtain 53 on the top of the bag 50 is extended outwardly from the top of said bag and is placed over the outside of the upper sleeve 3. The lid 2 is placed on top of the box 1 in such a manner as to squeeze the curtain between the lid lip 45 and the upper sleeve 3. The liquid inlet 51 of the bag 50 is pulled from the inside of the box 1 and out through the lid aperture 44. The liquid inlet is secured by the slide gate 61. The liquid outlet 52 of the bag 50 is pulled from the inside of the box 1 and out through the base aperture 10. Making certain that the liquid outlet 52 is closed to prevent the outward flow of liquid by way of gravity, the bag 50 is filled with a liquid, such as water (or any other liquid that is compatible with the materials from which the bag is constructed) through the liquid inlet 51. Once the box is assembled, fork lift prongs can be inserted into fork lift channels 62 and the box 1 can be placed onto a cargo plane or truck for transport. The tie down loops 65 are used to secure the box during transport. A plurality of boxes may be stacked one upon the other, each box being secured to another box by sliding the slide bolts 63 on the top of one box into the holes 64 in the base of another box. After transporting the box When liquid is needed from the box 1, the liquid outlet 51 is opened and the liquid is collected and used as needed.

EXAMPLE OF A BOX FOR MILITARY USE

A box of the present invention can be manufactured from lightweight aircraft-grade 6061-T6 aluminum alloy and can be designed to fit perfectly within the cube of a standard 463L aircraft pallet. All hardware parts of the box can be made of either aluminum alloy or stainless steel. The entire box is rust proof and is completely lockable to enhance the security of potable water. The boxes are weather resistant and can withstand even the harshest wind, temperature, humidity and precipitation extremes. The boxes can be assembled using all welded construction and incorporating the seven-hinge system to allow the box to be folded into itself from an erected height of 54 inches down to a mere 18 inches. The boxes may be stacked on top of one another, either collapsed or fully erected; full of water, empty or any combinations thereof, for palletizing or general liquid storage—a real space saver since twenty empty and collapsed boxes occupy the same airlift space as does one empty water buffalo. The difference in available gallonage between the two airlift configurations is 6000 gallons: 400 gallons in the current water buffalo and 6400 gallons in the twenty boxes of this invention. Erected empty boxes are rated for and will indefinitely withstand up to and including 2000 pounds of weight loaded on top of them, without any loss of structural integrity. An added feature of the box is the ability to interconnect with tanks stacked on top of one another by using a flexible hose. This doubles the water holding capacity in the same footprint. Each container has a 2-inch non-corroding plastic top and bottom NPT fitting. A bottom non-corroding valve is provided to facilitate positive control during removal of the liquid product. All fittings can be FDA approved and of food grade quality. A lockable lid is provided for the box and is easily removed from an erected box to add or remove the 10-mil thick polyethylene liner bag, which can be FDA-approved to hold potable water. The lid weighs only 15 pounds and can be removed or replaced with little effort by a single person. In the collapsed configuration, the lid also secures to the base of the box. The lid has two locking brackets that positively secures stacked containers (either collapsed or erected) thus eliminating a potentially serious safety hazard. Each box has two reinforced 10 inch alloy fork lift channels that allow for easy transport of individual or stacked boxes using any available type of fork lift. Securely stacked and locked boxes of the present invention reduce the worry of dumping the load when transporting by forklift over rough or unimproved terrain. Two tie down rings are provided at either corner of the box for ease of palletizing and/or securing the load and are rated at 4000 pounds each. Fur individual cargo movement wheels can be provided to allow a single person to freely move the boxes, either full or empty, on improved surfaces without the aid of a forklift. Wheels are rated to hold up to 1000 pounds each (4000 pounds total for each box) and are constructed to manually fit into fork lift channels on the box. A set of four wheels will support two fully loaded stacked and secured containers. Various types of hoses may be used to provide a conduit for liquid transfer from one box to another.

A 220 gallon box has approximate dimensions of 38 inches long by 38 inches wide by 50.5 inches high. In its collapsed state, the box is only 18 inches high. A 320 gallon box has approximate dimensions of 42 inches wide by 46 inches wide by 54.5 inches high. In its collapsed state, the box is still only 18 inches high.

Lightweight aluminum alloy provides a greatly reduced container weight and size over existing systems. This translates directly into fewer aircraft required to move critical assets. This increases aircraft fuel load capacity, more passengers, more transported cargo or lighter takeoff and landing weights per flight. Reducing the shipping container size and weight is a true force multiplier.

A tremendous weight savings is achieved using the current invention. For a requirement of 4000 gallons of water at a particular location, ten water buffalos would have to be airlifted with total empty weight of 27,300 pounds. This same requirement can be met using boxes of the present invention having a total empty weight of only 2,145 pounds. This saves 25,155 pounds.

An airlift requirement of forty water buffalos (totaling 16,000 gallons) would require three C-141 aircraft. Using the present invention, only 2.5 pallet positions would be required on a single C-141 aircraft. Ten pallet positions are still available for other cargo on the one required aircraft. The added cost for two additional aircraft with the water buffalos would run into the hundreds of thousands of dollars. Lighter cargo loads also equate to less airfield pavement stress per flight pass and thus lower maintenance costs for the field.

The box of the present invention is also ideal as a fire fighting platform in tent cities or camping areas. A portable pump can be added to increase the flow of water from the box.

While this invention has been described with reference to specific embodiments disclosed herein, it is not confined to the details set forth and the patent is intended to include modifications and changes which may come within and extend from the following claims.

I claim:

1. A collapsible box for storing and transporting liquid comprising:

a. a base having a bottom panel, the bottom panel having a front edge, a rear edge, a left edge, a right edge, and a base aperture;

b. a base lip extending upwardly along the edges of the bottom panel, including a front base lip attached to the front edge of the bottom panel, a rear base lip attached to the rear edge of the bottom panel, a left base lip attached to the left edge of the bottom panel, and a right base lip attached to the right edge of the bottom panel;

c. an upper sleeve comprising:

a rear panel having a bottom edge, a top edge, a left edge and a right edge, said rear panel being connected by a base hinge to the rear base lip along the bottom edge of the rear panel;

a rear left side panel connected by a left rear hinge to the rear panel along the left edge of the rear panel;

a front left side panel connected by a left central hinge to the rear left side panel along an edge of the rear left side panel distal to the rear panel;

a rear right side panel connected by a right rear hinge to the rear panel along the right edge of the rear panel;

a front right side panel connected by a right central hinge to the rear right side panel along an edge of the rear right side panel distal to the rear panel;

a front panel having a left edge, a right edge, a bottom edge and a top edge, said left edge being connected by a front left hinge to the front left side panel along an edge distal to the rear left side panel; said right edge being connected by a front right hinge to the front right side panel along an edge distal to the rear right side panel;

the combined length of the rear left side panel hinged to the front left side panel being less than the length of the rear panel; the combined length of the rear right side panel hinged to the front right side panel being less than the length of the rear panel;

the upper sleeve being foldable to an open position in which the bottom edge of the front panel extends along the front edge of the bottom panel, the rear left panel hinged to the front left panel extends along the left edge of the bottom panel, and the rear right side panel hinged to the front right side panel extends along the right edge of the bottom panel, such that the base lip surrounds the bottom edges of the upper sleeve;

the upper sleeve being foldable to a closed position in which the right and left side panels are folded about their respective right side and left side central hinges onto the rear panel; and the bottom panel, the front panel, the rear panel, and the side panels extend in substantially parallel planes;

d. a lid having a top panel, the top panel having a front edge, a rear edge, a left edge, a right edge, and a lid aperture;

e. a lid lip extending downwardly along the edges of the top panel, including a front lid lip attached to the front edge of the top panel, a rear lid lip attached to the rear edge of the top panel, a left lid lip attached to the left edge of,the top panel, and a right lid lip attached to the right edge of the top panel;

f. the lid lip being sized to selectively surround the top edges of the upper sleeve when the upper sleeve is in the open position, thereby forming an enclosure;

g. a liquid storage bag sized to fit inside the enclosure, said bag having a closeable liquid inlet in the top capable of fitting through the lid aperture, said bag having a closeable liquid outlet in the bottom capable of fitting through the base aperture, said bag having a curtain extending outwardly from the top of said bag such that the curtain is squeezed between the lid lip and the sleeve when the sleeve is in an open position and the lid is placed on top of the sleeve;

h. one or more base connectors to securely attach the base to the sleeve when the sleeve is in an open position; and i. one or more lid connectors to securely attach the lid to the sleeve when the sleeve is in an open position.

2. The box of claim 1 further comprising one or more latches to connect the base to the lid when the sleeve is in the closed position.

3. The box of claim 1 further comprising a plurality of tabs extending vertically downward on the outside of the sleeve, said tabs being placed so as to overlap the base lip when the sleeve is in an open position.

4. A plurality of the boxes of claim 1 further comprising a stacking latch on each box to safely secure one box to another box when the boxes are stacked one upon another.

5. The box of claim 1 wherein the bag is made of polyethylene and the remaining structure of the box is made from aluminum alloy.

6. The box of claim 5 wherein the polyethylene bag is 10 mils thick.

* * * * *